US006606896B2

(12) United States Patent
Tarasconi

(10) Patent No.: US 6,606,896 B2
(45) Date of Patent: Aug. 19, 2003

(54) TOOL SUPPORT AND LOCKING DEVICE IN SHEET METAL BENDING BRAKES

(75) Inventor: Gianluca Tarasconi, Parma (IT)

(73) Assignee: Toolspress S.r.l., Lesignano de' Bagni (IT)

( * ) Notice: Subject to any disclaimer, the term of this patent is extended or adjusted under 35 U.S.C. 154(b) by 97 days.

(21) Appl. No.: 09/796,642

(22) Filed: Mar. 2, 2001

(65) Prior Publication Data

US 2002/0053231 A1 May 9, 2002

(30) Foreign Application Priority Data

Nov. 7, 2000 (IT) ..... RE00A0111

(51) Int. Cl.[7] ..... B21D 37/04

(52) U.S. Cl. ..... 72/482.3; 72/482.2; 72/481.1; 72/462

(58) Field of Search ..... 72/482.1, 482.2, 72/482.3, 482.4, 481.1, 482.7, 482.6

(56) References Cited

U.S. PATENT DOCUMENTS 6,000,273 A * 12/1999 Stover ..... 72/481.1
6,003,360 A * 12/1999 Runk et al. ..... 72/482.2
6,446,485 B1 * 9/2002 Tarasconi ..... 72/481.1
6,450,004 B1 * 9/2002 Edmondson et al. ..... 72/482.3

* cited by examiner

*Primary Examiner*—David Jones
(74) *Attorney, Agent, or Firm*—Browdy and Neimark, P.L.L.C.

(57) ABSTRACT

The bending brake comprises an intermediate member (10) fixed to the upper toolplate of the brake, and at least one jaw (20) connected to the intermediate member (10) and rotatable about a horizontal axis (R) parallel to the longitudinal axis of the intermediate member (10); the lower portions (20') of the jaw (20) and of the intermediate member (10) are arranged to clamp and alternately release the tool shank (8). There are provided pressing members (30), carried by the intermediate member (10) and connected thereto in such a manner as to be able to slide in a transverse direction, to thrustingly act on the upper portion (20") of the jaw to cause it to rotate, and a thrust member (40) having its longitudinal axis (B) parallel to the longitudinal axis of the intermediate member (10). The thrust member (40) is connected to the intermediate member (10) in such a manner as to be able to slide in an axial direction without rotating about its own axis (B), and acts on the pressing members (30) in such a manner as to move them in a transverse direction as a result of its own axial movement, and can also be moved axially, on command, to an extent such as to produce consequent rotation of the jaw.

7 Claims, 10 Drawing Sheets

TOOL SUPPORT AND LOCKING DEVICE IN SHEET METAL BENDING BRAKES

TECHNICAL FIELD

This invention relates to sheet metal bending brakes and more particularly to the means for supporting and locking the upper tools used by these brakes.

BACKGROUND ART

Bending brakes generally comprise a structure having two opposing toolplates substantially lying in the same vertical plane, and of which one can move vertically. To the facing edges of the toolplates are fixed the means for supporting and locking the bending tools, which are aligned in succession and grouped as a plurality of upper tools and a plurality of lower tools (punch and die respectively).

Said tool support and locking means are fixed to the respective toolplates and are arranged to receive the tool shank such that it can be slid along the longitudinal axis of the toolplate and be locked in the desired position.

When the type of work changes, one or more tools have also to be changed, this being generally done by withdrawing or inserting the tools from or into the support and locking means in a longitudinal direction. Withdrawing, adding or changing a tool is a particularly delicate and even dangerous operation, in particular with regard to the upper tools, which can also be very long and heavy.

For this reason, tool support and locking means have been developed for bending brakes which also enable the tool to be withdrawn vertically, in the brake working direction.

The known means are rather complicated because they have to comprise safety means to prevent any accidental fall of the tool when it is released.

A fixture conforming to the known art, comprising said tool support and locking means, is described in EP 0494714, in which the tool support and locking means comprise a lower channel into which the upper portion of the tool (also known as the shank) is inserted.

The tool can be inserted from below into a seat having the same form as the shank, and locked in position by a plurality of pneumatically operated pistons which enter a longitudinal groove present in the tool shank. Each of said means also has a safety device comprising a lever for operating a peg movable within a hole in the support means which, when the shank has been inserted into the seat in said support and locking means, is maintained elastically inserted in a longitudinal cavity present in one of the vertical walls of said seat.

When a tool, for example one of those which form the upper punch of the brake, is to be changed, the locking pistons are retracted so that the tool remains supported only by the peg.

At this point the tool can be withdrawn in the direction of the toolplate edge, or, by pressing said lever, it can be withdrawn in a vertical direction.

This solution is costly to implement, and in addition the peg present in the safety device is easily damaged during use, so being unable to perform its functions.

An object of the invention is to overcome the aforementioned drawbacks within the framework of a rational, reliable and low-cost solution.

A further object of the invention is to provide tool support and locking means which can be used easily and safely by the operator.

DISCLOSURE OF THE INVENTION

These and further objects are attained by the invention as characterized in the claims.

The invention is described in detail hereinafter with the aid of the accompanying figures which illustrate some non-exclusive embodiments thereof by way of non-limiting example.

Figure 5:
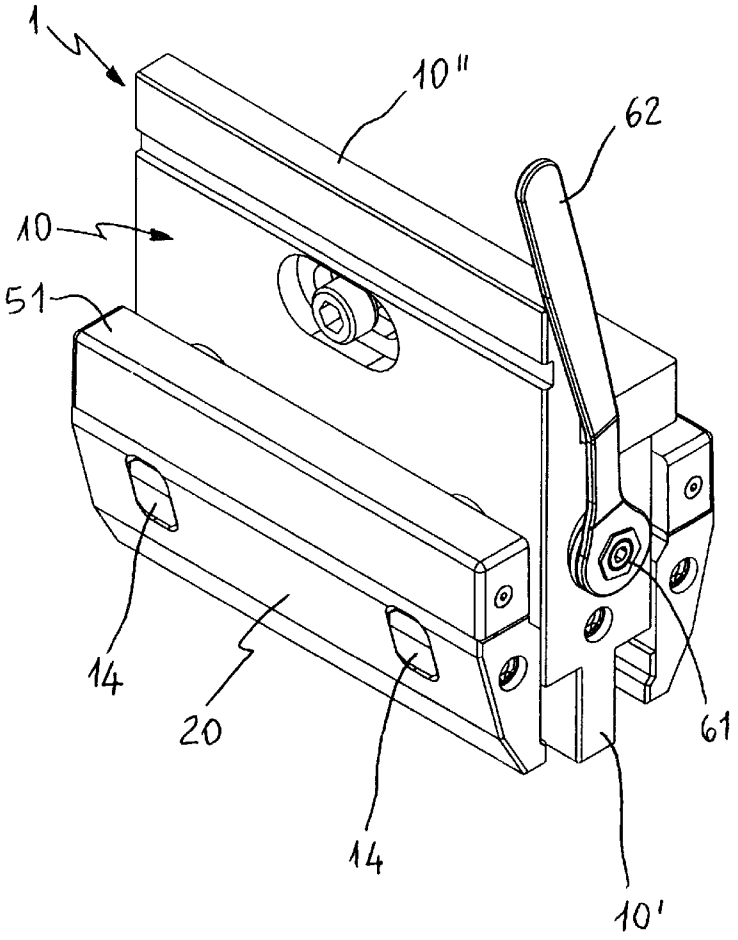
FIG. 5 is a perspective view of the first embodiment of the device of the invention.
Figure 1:
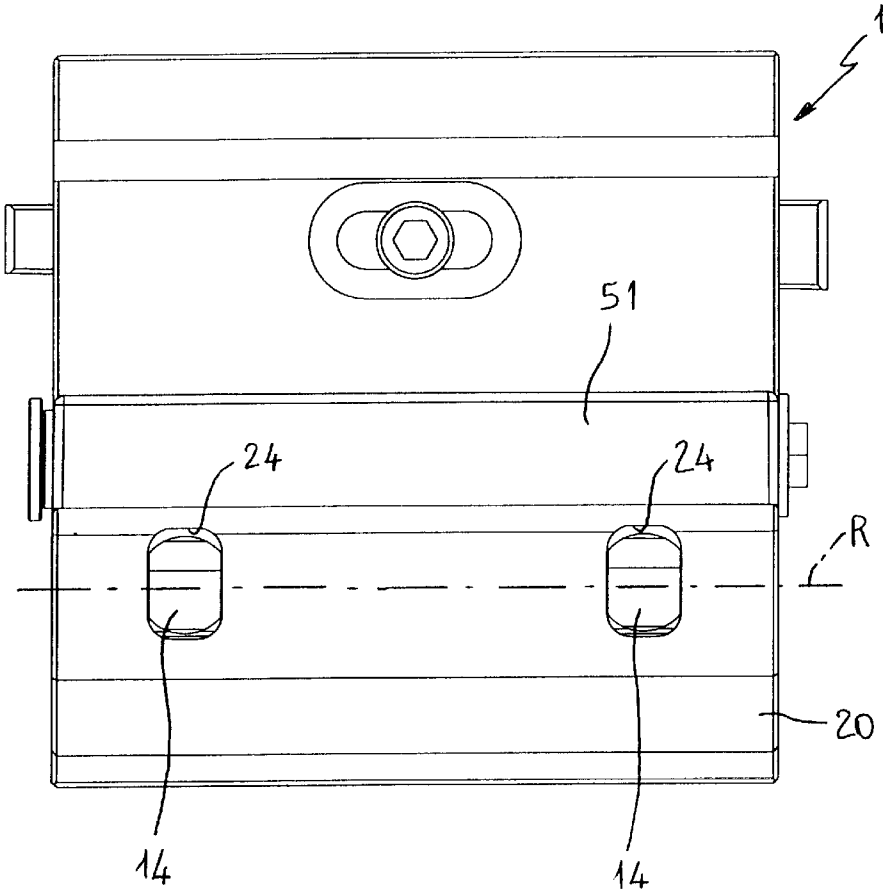
FIG. 1 is a vertical side elevation of a first embodiment of the device of the invention.

The device of the invention, indicated overall by 1, is rigidly connected, by known means, to the upper toolplate 5 (shown only schematically in FIG. 2) of the brake.

Usually, each upper toolplate 5 of a sheet metal bending brake carries a series of devices 1, aligned in succession, which carry a plurality of tools 7, aligned in succession, and secured to the relative devices 1. Each device 1 comprises, elongate in a horizontal direction, an intermediate member 10 fixed to the upper toolplate 5 of the brake via its own upper end portion 10", and at least one jaw 20 secured to the intermediate member 10 and rotatable about a horizontal axis R parallel to the longitudinal axis of the intermediate member. The lower end portion 20' of the jaw and the lower end portion 10' of the intermediate member are arranged to clamp and alternately release the upper shank 8 of the tool 7 following rotation of the jaw 20 in one direction or the other. In particular, the upper shank 8 presents a longitudinal groove 81 into which there is inserted a corresponding longitudinal projection 201 provided in the lower end of the jaw 20.

Typically, two symmetrically equal jaws 20 are provided, positioned on one and the other side of the intermediate member 10, and symmetrical about the longitudinal central plane of the intermediate member 10. Said jaws 20 are arranged to grip and lock the tools 7 by means of their upper shank 8, and present at least three operative configurations: a configuration in which the tool 7 is forcibly locked; an intermediate configuration in which the tool 7 is released, i.e. is free to slide in a longitudinal direction while remaining suspended from the device 1; and a configuration in which the jaws 20 are at maximum opening, in which the tool 7 is free to descend from the device in a vertical direction.

According to the invention, pressing members 30 are provided, specifically two for each jaw 20, they being carried by the intermediate member 10 and connected to it in such a manner as to be able to slide in a transverse direction, to thrustingly act on the upper portion 20" of the jaw to cause it to rotate about the axis R.

A thrust member 40 is also provided, slidable within a through hole 12 provided in the intermediate member 10 and having its axis B parallel to the longitudinal axis of this latter. The thrust member 40 is connected to the intermediate member 10 in such a manner as to be able to slide in an axial direction, without rotating about its own axis B. The thrust member 40 is arranged to act on the pressing members 30 such as to move them in a transverse direction following its own axial movement, and is itself able to be moved axially, on command, to an extent such as to produce consequent rotation of the jaws 20.

In the embodiment shown in FIGS. 1–5, for each pressing member 30, the thrust member 40 presents a respective thrust surface 41, inclined to its longitudinal axis B and acting on a corresponding reaction surface 31 provided on the pressing member 30 and having the same orientation as the surface 41 to which it adheres, so that movement of the thrust member 40 in the longitudinal direction B results in a corresponding movement of the reaction member 30 in the transverse direction (perpendicular to the longitudinal axis of the intermediate member 10) in accordance with the well-known principle of inclined planes.

In detail, and in the embodiment shown in FIGS. 1–5, the thrust member 40 is of general elongated cylindrical shape with a longitudinal axis B and of constant cross section; in an intermediate position there is provided a longitudinal groove 42 in which there engages an pressing pin 42*a* rigid with the intermediate member 10. By virtue of the coupling between the pin 42*a* and the longitudinal faces of the groove 42, the member 40 can slide freely in a longitudinal direction within the hole 12, without however rotating about its own axis B.

In the proximity to each end of the hole 12, there are provided in the intermediate member 10 two axially opposing horizontal transverse holes 13 communicating with the longitudinal hole 12, they having the same axis D perpendicular to and cutting the axis B. An pressing member 30 of general cylindrical shape is inserted as an exact fit into each of the holes 13 and is slidable in the direction D.

At each of the members 30, the thrust member 40 presents a lateral groove defining both the thrust surface 41 and a second surface 43 on the base of the groove, parallel to the longitudinal direction; in contact with the surface 41 there is positioned the reaction surface 31 of the pressing member 30, located on the rear end of this latter. To the side of the surface 31, the member 30 presents a second surface 33, arranged to make contact with the surface 43.

In an intermediate position (in the vertical direction) between the upper portion 10" and lower portion 10' and below the hole 12, the intermediate member 10 carries two transverse horizontal beams 14 arranged to support the two jaws 20. These present two through apertures 24, through which the corresponding ends of the beams 14 are inserted; the beams 14 and the jaws 20 are connected together by pins 25 the axes of which are horizontal and longitudinal, and define the axes of rotation R of the jaws 20.

In a position facing the pressing members 30, in contact with the inner surface of the jaws 20 there are positioned a like number of pressed members 50, on which the pressing members 30 press when thrust outwards, as described below.

Said members 50 rest against the surface of the jaws 20 and are secured, against movements in a longitudinal direction, by two latches 51, one for each jaw 20, which are secured to the other portion of the jaws 20 in a manner enabling them to slide relative thereto in a longitudinal direction. Each latch 51 is maintained in a normal position to the jaw 20, by longitudinally acting springs 52; when in this position, the members 50 are faced by the members 30.

In the first two embodiments (shown in FIGS. 1–8), to produce the axial movement of the thrust member 40, there is provided a second thrust member 60, engaged with the intermediate member 10 by a male-female screw coupling, such that its rotation results in its consequent axial movement relative to the intermediate member 10, this axial movement producing a corresponding axial movement of the first thrust member 40, and means for rotating the second thrust member 60 on command.

In particular, the second thrust member 60 is coupled to the intermediate member 10 such that its axis coincides with the axis of the first thrust member 40, and is hence parallel to the longitudinal axis of the member 10, it being positioned directly in contact with the first thrust member 40, to which it is axially secured by an axial screw 60*a*.

In detail, the second thrust member 60 is of cylindrical form with a threaded outer surface, engaged with a corresponding threaded cylindrical surface 12' provided at one end of the longitudinal hole 12, close to a longitudinal end of the intermediate member 10. The member 60 possesses, accessible from the outside, a portion 61 of shape such as to be able to be engaged for rotation by an external operating member, for example a manually operated lever 62.

In the operation of the first embodiment, by means of the lever 62 (or by any other suitable means) the second thrust member 60 is rotated in one direction or the other, with consequent axial movement of the member 60 in the longitudinal direction, to axially move the thrust member 40 through an equal length, again in the longitudinal direction. The movement of the thrust member 40 produces a corresponding axial movement of the four pressing members 30 in a horizontal transverse direction, these acting against the pressed members 50 to determine the angular position of the jaws.

Figure 2:
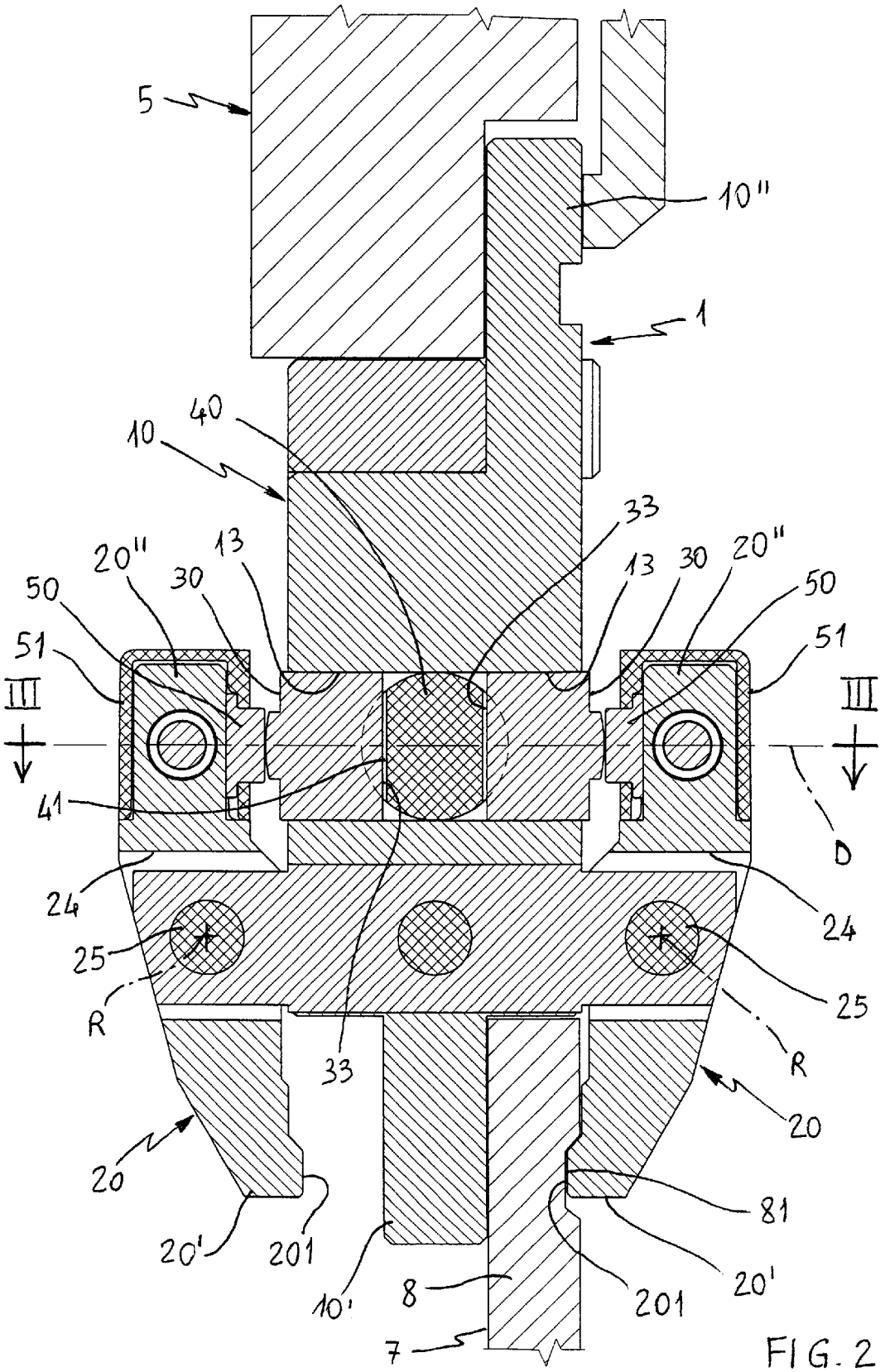
FIG. 2 is a section on the plane II—II of FIG. 3, showing the jaws in the tool locking position.
Figure 3A:
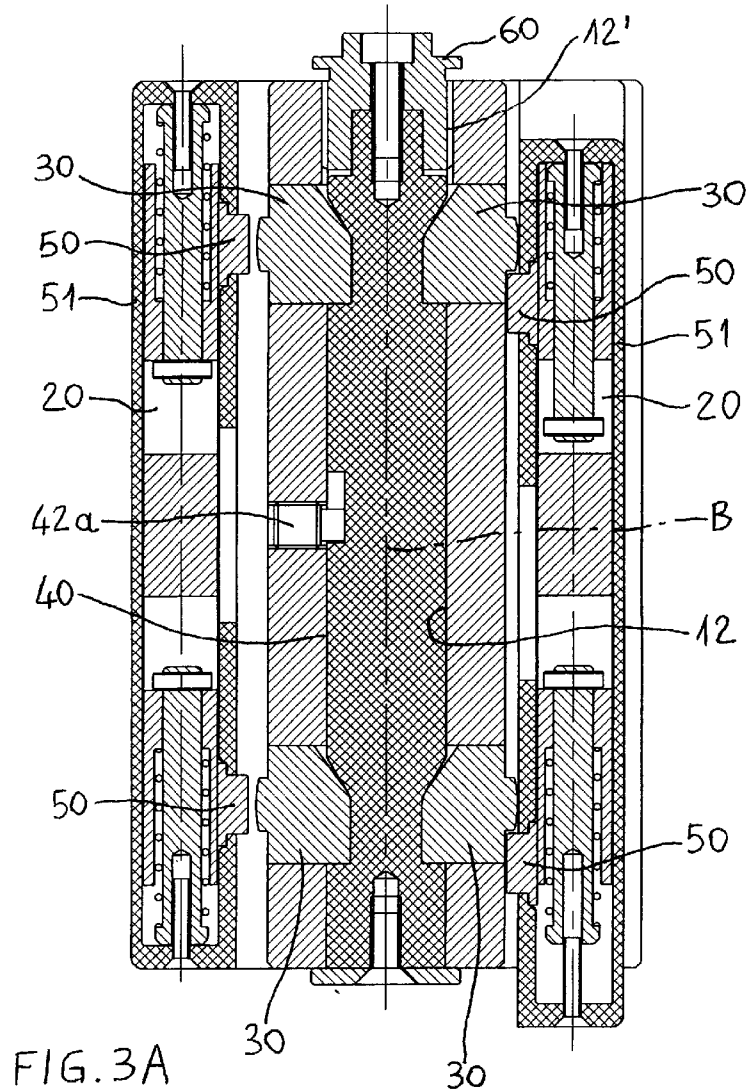
FIG. 3A is the same section as FIG. 3, but showing the jaws at maximum opening.
Figure 3:
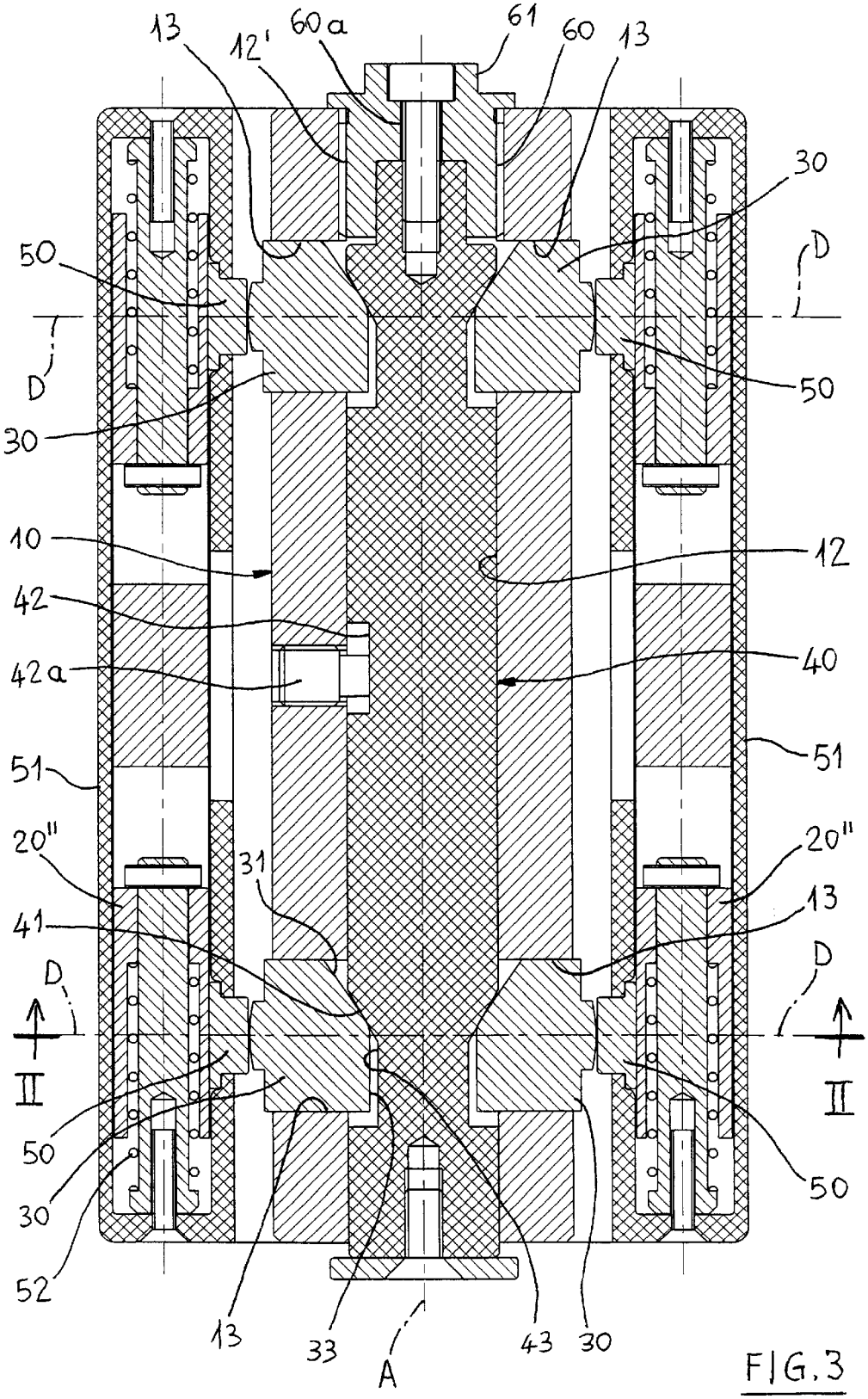
FIG. 3 is a section on the plane III—III of FIG. 2.
Figure 4:
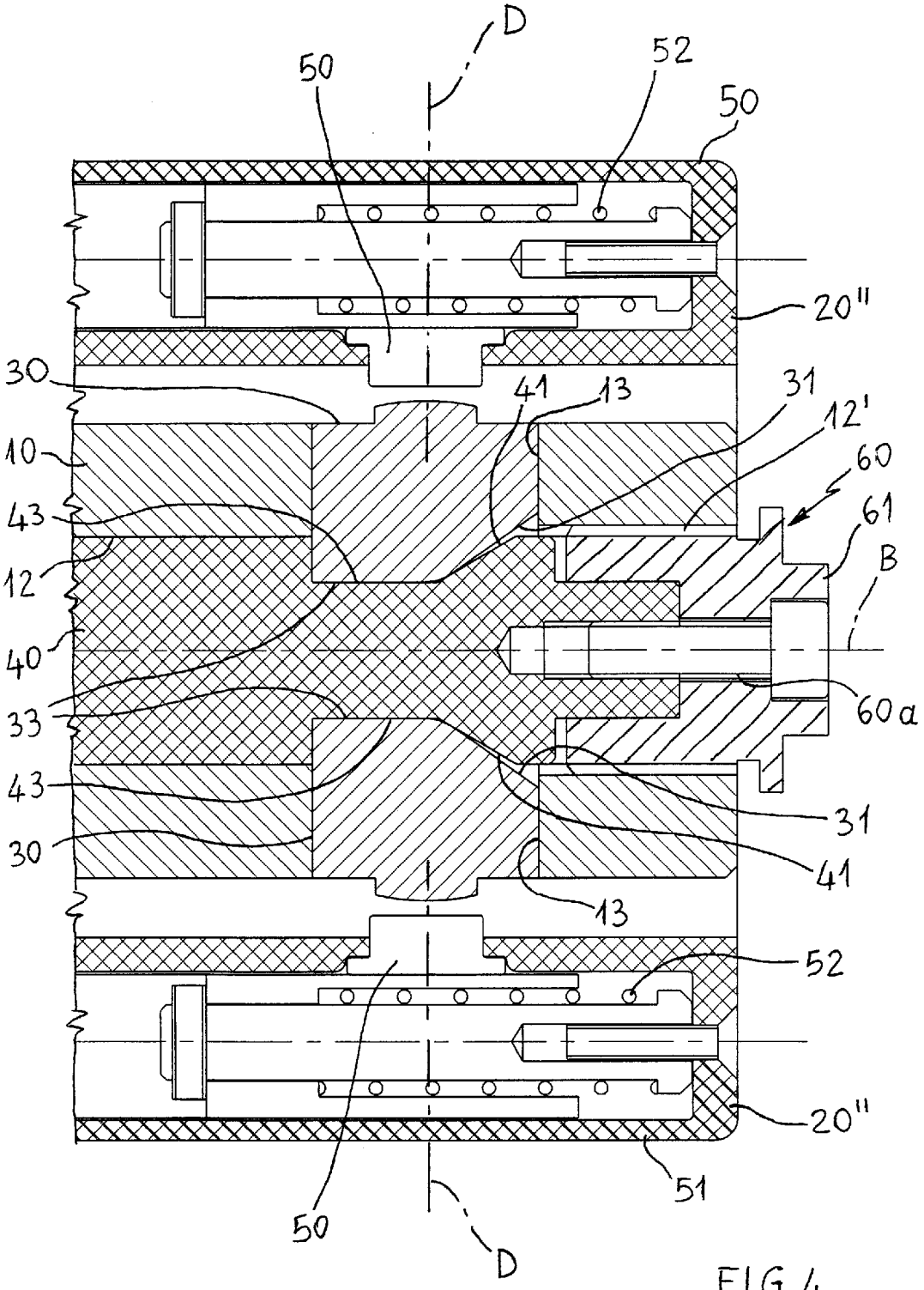
FIG. 4 is a detail of FIG. 3, showing the jaws in the tool release configuration.

By rotating the thrust member 60 in a first direction, the thrust member 40 is made to move in a first direction (downwards in FIG. 3) in which the thrust surfaces 41 are withdrawn from the pressing members 30; the members 30 are consequently thrust outwards by the intermediate member 10 against the pressing members 50, to consequently produce a rotation of the jaws 20 such that their lower portions 20' approach the central vertical plane of the member 10 and hence forcibly clamp the tool shank 8 (see FIGS. 2 and 3 in particular).

Rotating the thrust member 60 in the opposite direction produces movement of the thrust member 40 in a second direction (upwards in FIG. 3) in which the thrust surfaces 41 are withdrawn from the pressing members 30. Consequently, the members 30 can re-enter the member 10, until their surfaces 33 are bought into contact with the surfaces 43 positioned on the base of the grooves in the thrust member 40 (see FIG. 4 in particular). A small gap (a few millimetres) hence remains between the pressing members 30 and the pressed members 50, so that the jaws 20 no longer clamp the shank 8, however their lower portions 20' are maintained at a distance from the portion ten' such that the projection 201 does not completely leave the groove 81, and the shank 8 is therefore unable to descend into a vertical direction but remains instead supported by the jaw 20 and member 10. In this configuration, the tool 8 is free to be withdrawn from the member 10 and relative jaw 20, in a longitudinal direction.

Figure 2A:
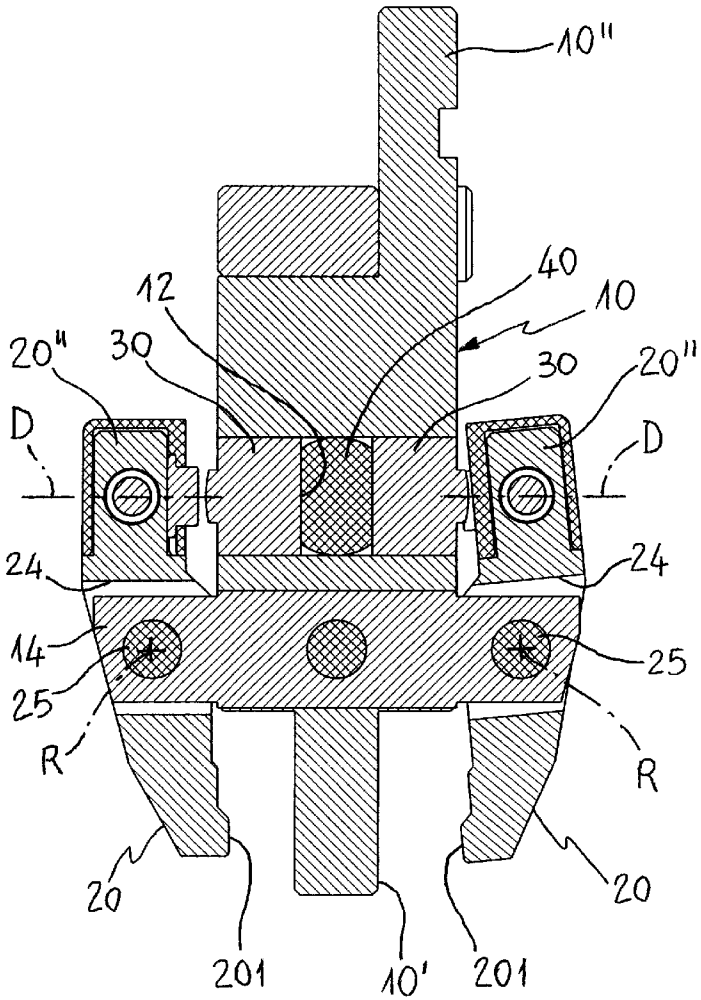
FIG. 2A is the same section as FIG. 2, but showing the jaws at maximum opening.

Finally, by moving the latch 51 from its normal position in a longitudinal direction, the pressed members 50 are moved sideways from the pressing members 30. Hence the gap between the pressing members 30 and the side of the jaw 20 (now without the members 50) increases, with the result that the extent of rotation of the jaw increases to the point at which its lower portion 20' can be moved to the extent of totally releasing the shank 8, even for vertical movement (see in particular the right jaw of FIGS. 2A and 3A).

Figure 8:
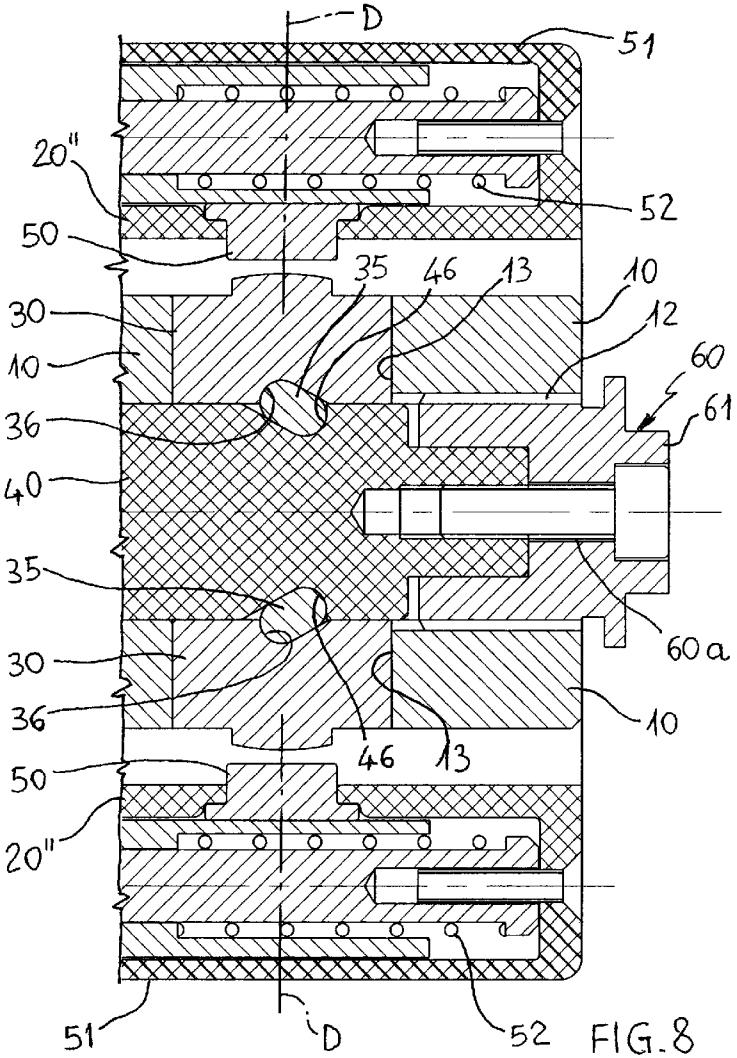
FIG. 8 is a detail of FIG. 7, showing the jaws in the tool release configuration.
Figure 6:
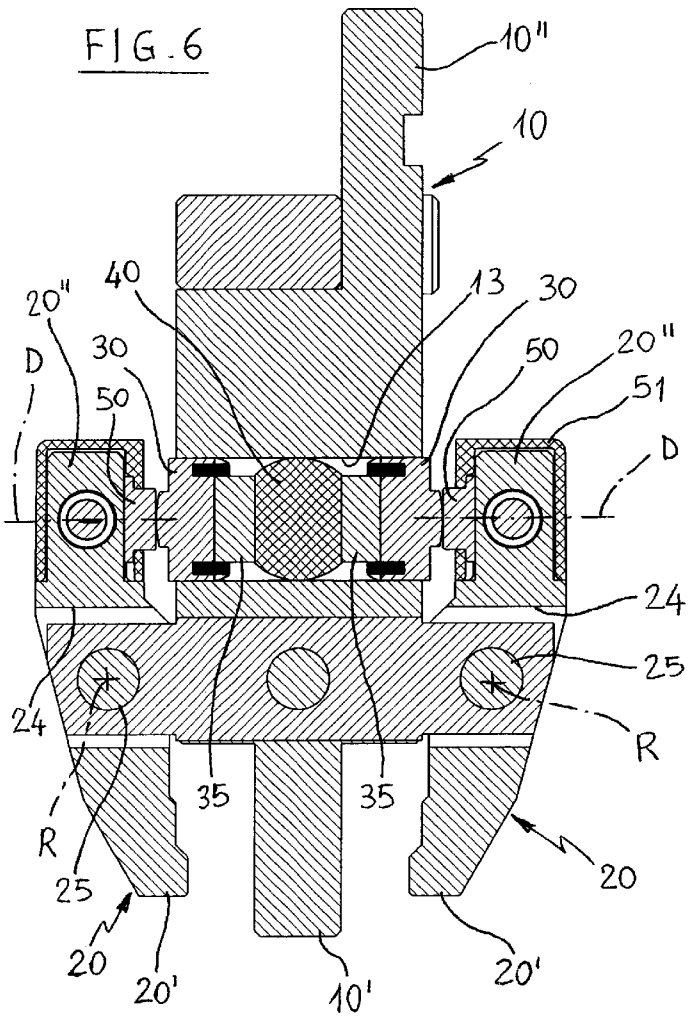
FIG. 6 is a section such as that of FIG. 2, through a second embodiment of the device of the invention.
Figure 7:
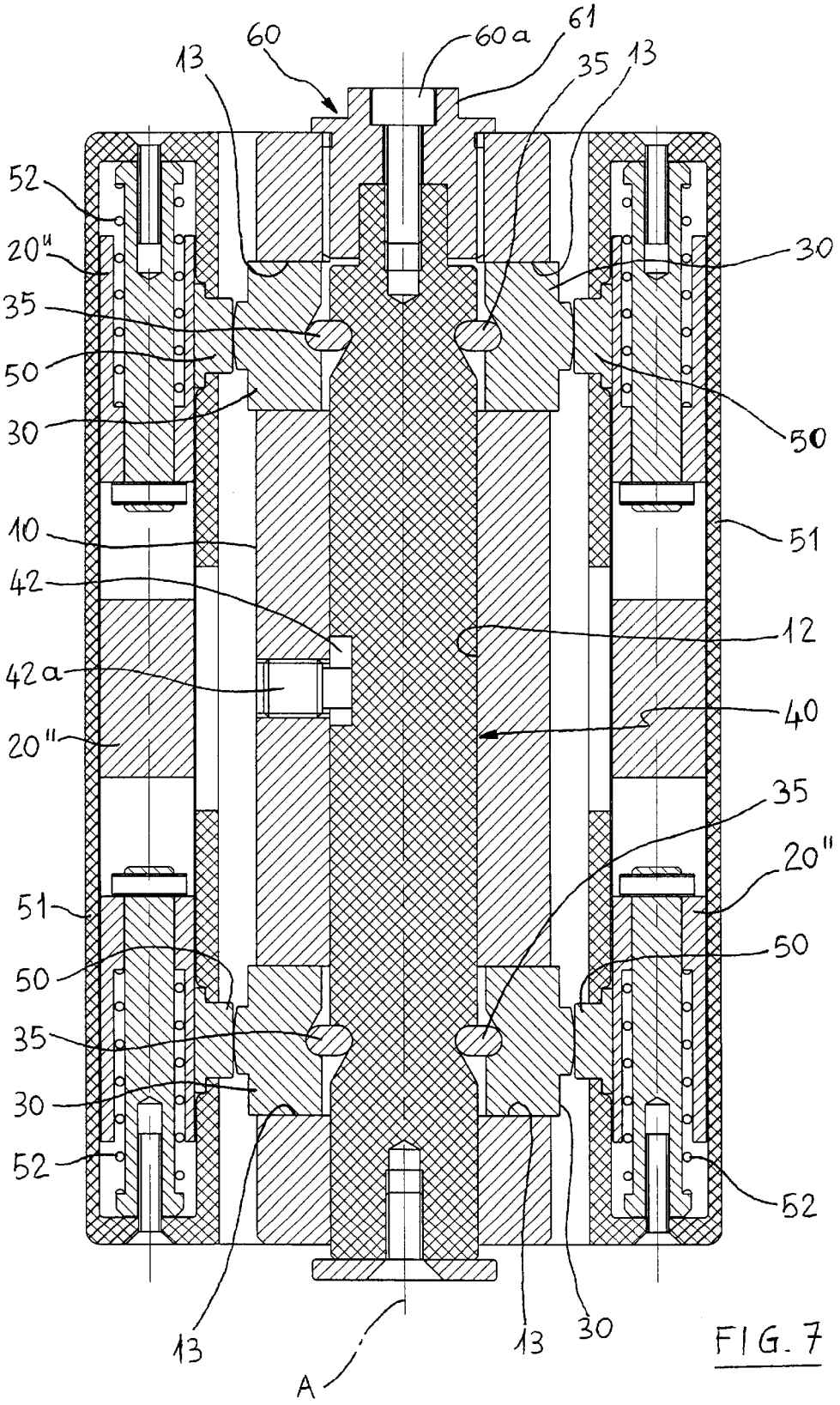
FIG. 7 is a section on the plane VII—VII of FIG. 6.
Figure 9:
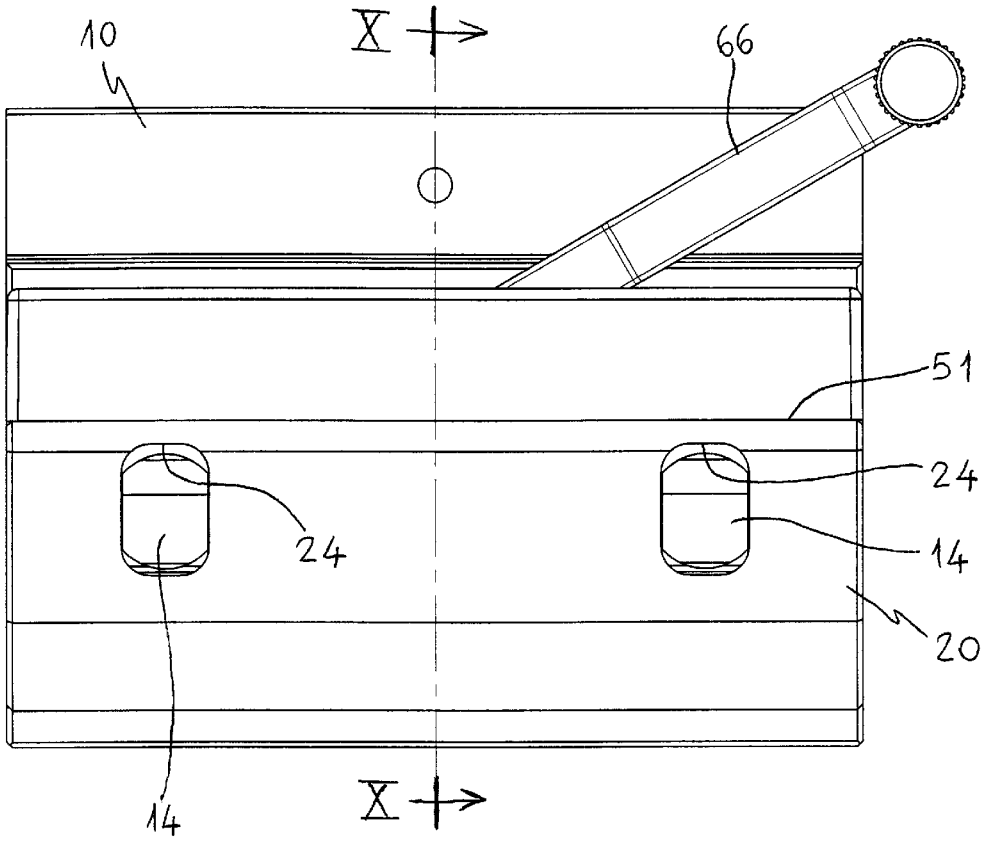
FIG. 9 is a vertical side elevation of a third embodiment of the device of the invention.
Figure 12:
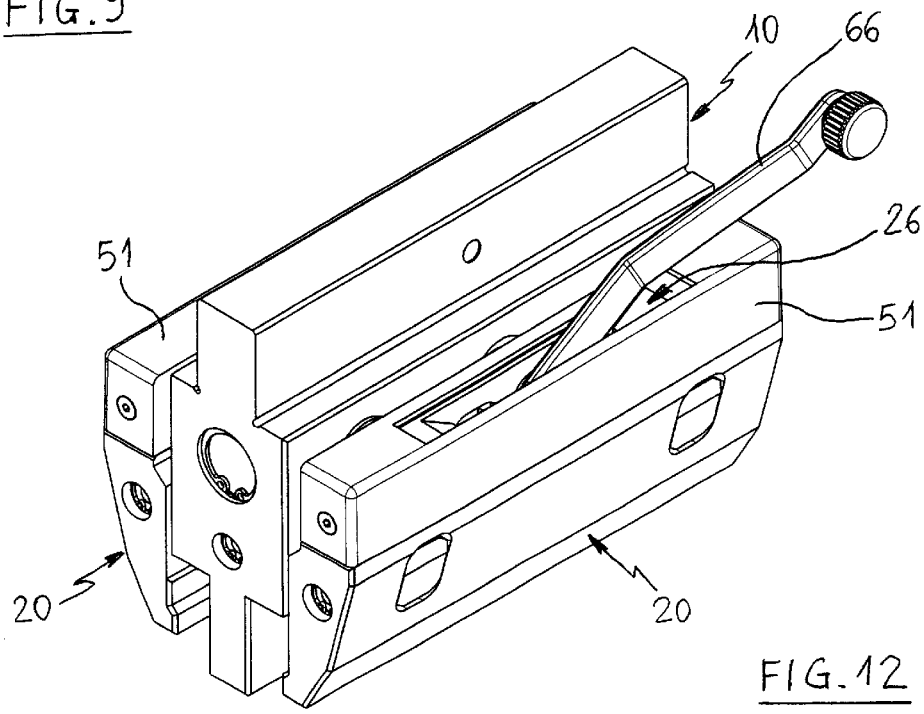
FIG. 12 is a perspective view of the third embodiment of the device of the invention, shown in FIG. 9.
Figure 11A:
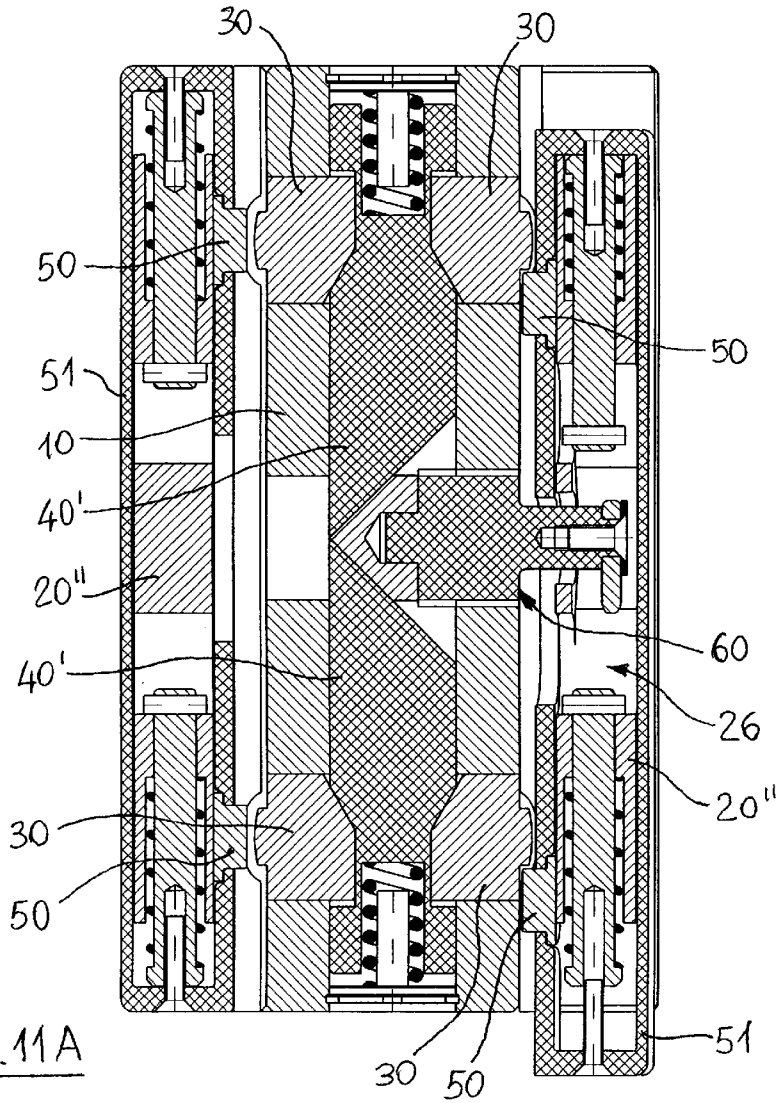
FIG. 11A is the same section as FIG. 11, but showing the jaws at maximum opening.
Figure 10:
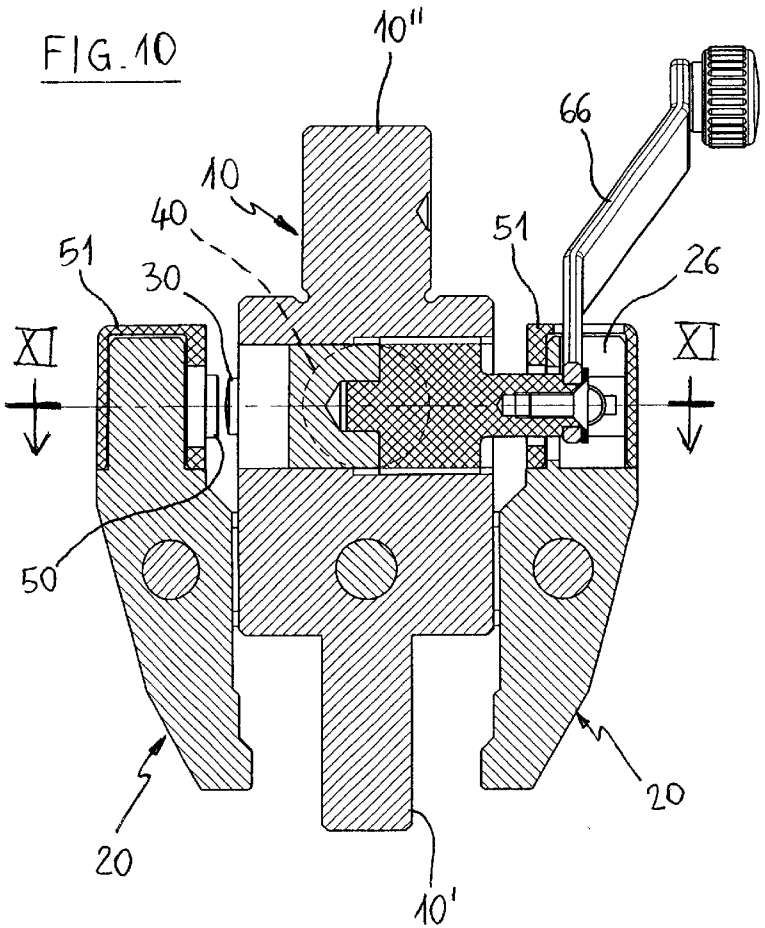
FIG. 10 is a section on the plane X—X of FIG. 9.
Figure 11:
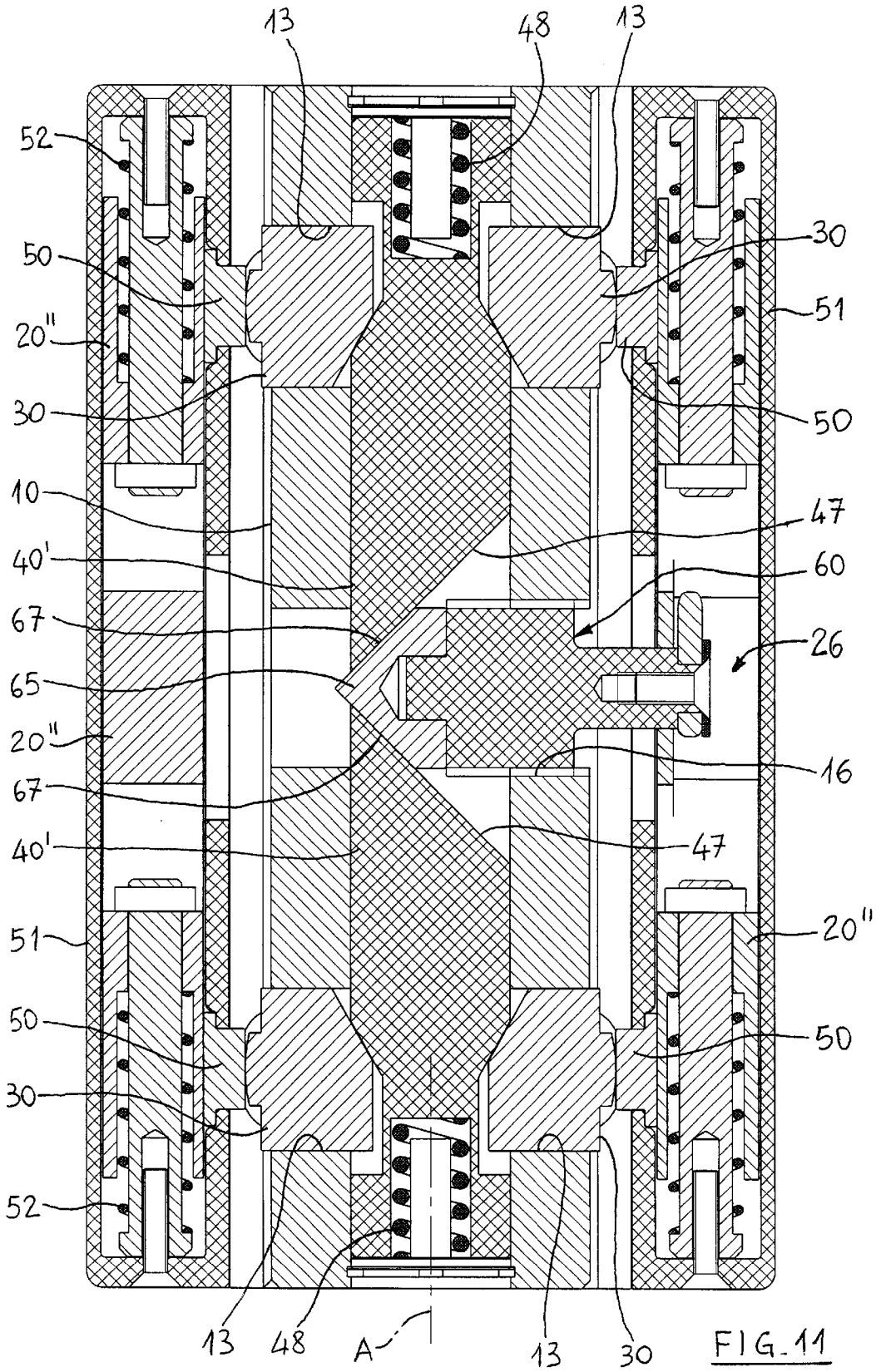
FIG. 11 is a section on the plane XI—XI of FIG. 10.

The second embodiment, shown in FIGS. 6–8, differs from the first only with regard to the means for making the movement of the thrust member 40 in the longitudinal direction result in a corresponding movement of the pressing members in the transverse direction.

In this embodiment, to reduce the resistance provided by the sliding between the surfaces 31 and 41, the thrust member 40 is connected to the pressing members 30 by respective connecting rods 35, which act in axial compression and have their ends rounded and resting against corresponding opposing rounded seats 46 and 36 which face each other and pertain to the thrust member 40 and pressing member 30 respectively.

The two seats 36 and 46 can be moved axially towards each other until they mate (second end position—FIG. 7), or be moved to an axial distance apart (first end position—FIG. 8).

In passing from the first to the second position, the connecting rods 35 increase their angle to the longitudinal axis, until they assume a transverse position (FIG. 7). In this position, the pressing members 38 are therefore forced out of the intermediate member 10 to a maximum extent, against the pressed members 15, to consequently produce a rotation of the jaws 20 such as to forcibly clamp the tool shank 8 (see FIGS. 6 and 7 in particular).

In contrast, in passing from the second to the first position, the connecting rods 35 decrees their angle to the longitudinal axis, until when in the first position (FIG. 8) the members 38 are directly in contact with the thrust member 40. In this position there therefore remains a small gap (a few millimeters) between the pressing members 30 and the pressed members 15 and consequently and the jaws 20 no longer clamp the shank 8, while however maintaining a distance from the portion and 10' such that the projection 201 does not totally escape from the groove 81.

The third embodiment differs from the first only with regard to the means for moving the thrust member 40 in a longitudinal direction, on command, to an extent such as to produce consequent rotation of the jaws 20.

In this embodiment, the thrust member 40 is divided into two thrust half-members 40', positioned in the hole 12 and having their rear ends urged one towards the other, at the central point of the hole 12, by springs 48; said ends are shaped to form respective reaction surfaces 47 inclined (by about 45 degrees) to the longitudinal axis B. The second thrust member 60 is inserted, with male-female screw coupling, into a transverse threaded central hole 16 in the intermediate member 10, with its axis of rotation perpendicular to the axis of the thrust half-members 40', and presents a head 65 having two wedge-inclined thrust surfaces 67 positioned in contact with the said reaction surfaces 47, such that movement of the second thrust member 60 in the transverse direction causes a corresponding movement of for the first thrust half-members in the longitudinal direction.

The outer end 61 of the second thrust member 60 is housed in a cavity 26 provided in the top of one of the jaws 20 and to it there is connected a manual operating lever 66, disposed in a position lateral to the device 1.

In operation, the second thrust member 60 is rotated in one direction or the other by the lever 66 (or by any other suitable means) with consequent axial movement, in the transverse direction, of the member 60 itself, which moves the thrust half-members 40' in the longitudinal direction, in a centrifugal sense. The movement of the thrust half-members 40' produces a corresponding axial movement of the four pressing members in a horizontal transverse direction, these acting against the pressed members 50 to determine the angular position of the jaws in the same manner and with the same results described above for the first and second embodiments.

Numerous modifications of a practical and applicational nature can be made to the invention, but without deviating from the scope of the inventive idea as claimed below.

What is claimed is:

1. A tool support and locking device for a sheet metal bending brake, comprising an intermediate member (10), elongate in a horizontal direction and fixed to an upper toolplate of the brake, and at least one jaw (20) connected to the intermediate member (10) and rotatable about a horizontal axis (R) parallel to a longitudinal axis of the intermediate member (10), lower portions (20') of the jaw (20) and of the intermediate member (10) being arranged to clamp and alternately release a tool shank (8) following rotation of the jaw (20) in one direction or another, pressing members (30) carried by the intermediate member (10) and connected thereto in such a manner as to be able to slide in a transverse direction, to thrustingly act on an upper portion (20") of the jaw to cause it to rotate, and a thrust member (40) having a longitudinal axis (B) parallel to the longitudinal axis of the intermediate member (10), wherein said thrust member (40) is connected to the intermediate member (10) in such a manner as to be able to slide in an axial direction without rotating about the longitudinal axis (B) thereof, and acts on the pressing members (30) in such a manner to move the pressing members in a transverse direction as a result of axial movement thereof, and can also be moved axially when actuated to produce consequent rotation of the jaw.

2. A device as claimed in claim 1, further comprising a second thrust member (60), engaged with the intermediate member (10) by a male-female screw coupling so that a rotation of the second thrust member results in an axial movement relative to the intermediate member (10), the axial movement producing a corresponding axial movement of the first thrust member (40), and further comprising means (62, 66) which rotates the second thrust member (60).

3. A device as claimed in claim 2, wherein said second thrust member (60) is coupled to the intermediate member (10) so that an axis of rotation of the second thrust member is parallel to the longitudinal axis of intermediate member, said second thrust member (60) being positioned directly in contact with the first thrust member (40).

4. A device as claimed in claim 3, wherein said second thrust member (60) is associated with a longitudinal end of the intermediate member (10) and possesses a portion (61) accessible from outside, engaged for rotation by an external operating device (62).

5. A device as claimed in claim 2, wherein said first thrust member (40) is divided into two half-members (40') having rear ends thereof close together and shaped to form respective reaction surfaces (47) inclined to the longitudinal axis of the first thrust member, the second thrust member (60) being coupled to the intermediate member (10) such that the axis of rotation of the second thrust member is perpendicular to an axis of the thrust half-members (40'), and presents a head (65) having two wedge-inclined thrust surfaces positioned in contact with said reaction surfaces (47), movement of the second thrust member (60) in a transverse direction causing a corresponding movement of the first thrust half-members (40') in a longitudinal direction.

6. A device as claimed in claim 1, wherein the thrust member (40) provides, for each pressing member (30), a respective thrust surface (41) inclined to the longitudinal axis (B) of the thrust member and acting on a corresponding reaction surface (31) of the pressing member (30), movement of the thrust member (40) in a longitudinal direction thereof causing a corresponding movement of the pressing members (30) in a transverse direction thereof.

7. A device as claimed in claim 1, wherein the thrust member (40) is connected to the pressing members (30) by respective connecting-rod means (35) acting by axial compression and having ends thereof bearing against corresponding mutually facing opposing seats to the thrust member (40) and to the pressing member (30) respectively, movement of the thrust member (40) in the axial direction causing a corresponding movement of the pressing members (30) in the transverse direction.

* * * * *